US006550194B2

(12) United States Patent
Jackson et al.

(10) Patent No.: US 6,550,194 B2
(45) **Date of Patent: *Apr. 22, 2003**

(54) WINDOW BUCK SYSTEM FOR CONCRETE WALLS AND METHOD OF INSTALLING A WINDOW

(75) Inventors: James W. Jackson, Middletown, OH (US); John W. Poynter, Monroe, OH (US)

(73) Assignee: Feather Lite Innovations, Inc., Springboro, OH (US)

( * ) Notice: Subject to any disclaimer, the term of this patent is extended or adjusted under 35 U.S.C. 154(b) by 90 days.

This patent is subject to a terminal disclaimer.

(21) Appl. No.: 09/782,734

(22) Filed: Feb. 13, 2001

(65) Prior Publication Data

US 2002/0047082 A1 Apr. 25, 2002

Related U.S. Application Data

(63) Continuation of application No. 09/232,078, filed on Jan. 15, 1999, now Pat. No. 6,185,884.

(51) Int. Cl.[7] ..... E06B 1/04

(52) U.S. Cl. ..... 52/215; 249/39; 249/35; 249/177; 249/184

(58) Field of Search ..... 52/215; 249/39, 249/35, 177, 184

(56) References Cited

U.S. PATENT DOCUMENTS

| | | | | |
|---|---|---|---|---|
| 2,787,820 A | | 4/1957 | Shields et al. | |
| 2,893,235 A | | 7/1959 | Goldberg | |
| 2,901,810 A | | 9/1959 | Richards | |
| 3,769,769 A | | 11/1973 | Kohl | |
| 3,995,843 A | | 12/1976 | Kasteler | |
| 4,430,831 A | | 2/1984 | Kemp | |
| 4,589,624 A | | 5/1986 | Jones | |
| 5,169,544 A | | 12/1992 | Stanfill et al. | |
| 5,319,884 A | | 6/1994 | Bergeron | |
| 6,185,884 B1 | * | 2/2001 | Myers et al. | 52/215 |

FOREIGN PATENT DOCUMENTS

| | | | | |
|---|---|---|---|---|
| EP | 0 127 700 A1 | * | 5/1983 | 52/215 |
| EP | 0 568 522 A1 | * | 4/1993 | 52/215 |
| FR | 2 551 484 A1 | * | 8/1983 | 52/215 |

* cited by examiner

*Primary Examiner*—Lanna Mai
*Assistant Examiner*—Dennis L Dorsey
(74) *Attorney, Agent, or Firm*—Wood, Herron & Evans, LLP

(57) ABSTRACT

A system and associated method for forming a window opening in a poured concrete wall and installing a window therein includes a two-piece reusable window buck having a retainer temporarily coupled thereto. The retainer becomes partially embedded in the poured concrete wall and after the window buck is removed from the window opening formed in the wall, the window is easily and conveniently installed in the window opening and secured therein by the window retainer and cooperating spring clip on the window frame without the need for additional mechanical fasteners or tools.

13 Claims, 8 Drawing Sheets

WINDOW BUCK SYSTEM FOR CONCRETE WALLS AND METHOD OF INSTALLING A WINDOW

This is a continuation in part of U.S. patent application Ser. No. 09/232,078, filed on Jan. 15, 1999, issued as U.S. Pat. No. 6,185,884 on Feb. 13, 2001 and hereby incorporated by reference in its entirety.

BACKGROUND OF THE INVENTION

This invention relates to poured concrete walls, and more particularly, to a pouring window buck system and associated method for installing a window in a poured concrete wall.

In pouring walls of concrete such as residential basement walls, window openings are commonly formed in the concrete wall as it is being poured. In the past, it has been common to construct wood frames for window openings as a part of the wood wall forms for the concrete walls. After the poured concrete had set, the wood forms, including the wood window frames, were removed and at least the wood window frames had to be discarded. The cost of the wood window frames which are not reusable, and the labor required in building the frames were distinct disadvantages of this type of construction.

Another general method which has been used is a metal buck frame or surround which is positioned between the wall forms and cast in place in the concrete wall. When the wall forms are removed, the buck frame or surround is in place to form the periphery of the window opening. Unfortunately, these types of systems have been found to be subject to deformation during the pouring of the concrete. Additionally, cast in place buck frames or surrounds significantly increase the cost of a window installation because they are not reusable.

To avoid these disadvantages, various methods and systems have been proposed. For example, a reusable metal pouring window buck, which is positioned between the spaced wall forms, is one alternative. The bucks may be made in two parts or a single piece and when the concrete which has been poured around the buck has set, the buck is removed from the window opening formed in the resulting concrete wall. Typically, a window frame is detachably secured within the buck such that the window frame is cast in and remains in the window opening when the concrete sets and the buck is removed. Unfortunately, due to the heavy forces delivered by the concrete being poured around the buck, this method has proven, in many instances, to be unreliable to protect the window contained within the buck. In many instances, the window is damaged or broken during the pouring of the concrete requiring additional time, effort and expense in repairing or replacing the window cast in place in the poured concrete wall. Furthermore, vinyl window frames, while providing many advantages acknowledged in the industry are highly susceptible to being damaged during the pouring of the concrete wall in such systems.

Alternatively, the window buck may be constructed of more robust materials to withstand the forces generated by the pouring and curing of the concrete and avoid deformation to the window buck and window. However, such measures present significant installation and handling problems for the user since the more robust window buck is commonly much heavier and more difficult to manipulate. One such example of a robust and reusable window buck is disclosed in U.S. Pat. No. 6,185,884, assigned to the assignee of this invention. While the system and method shown in that patent has proven to be a dramatic advancement over known systems, improvements are still needed to minimize production costs and maximize ease of use of the window buck system for some applications.

Another alternative to the removable pouring buck and window frame combination is a removable pouring buck which allows a window to be installed into the window opening in the concrete wall after the buck has been removed. In the past, one disadvantage to such systems is the need for additional and often complicated or cumbersome fasteners to secure the window frame into the window opening. Typically, the window frame must be screwed, nailed, anchored or otherwise secured into the window opening with an additional fastener thereby requiring additional installation work, materials, tools and labor. Moreover, in many such systems, the window cannot be easily removed for cleaning, repair and/or replacement once installed in the window opening.

A shortcoming of many known systems for installing windows in poured concrete walls is the inability to provide an accurate and stable positioning for the pouring buck, frame or the like between the spaced wall forms. This is very important because the position and orientation of the pouring buck is the resulting position and orientation of the window in the poured concrete wall. In the past, one method to maintain the position of the pouring buck between the wall forms has been to sandwich the buck between the spaced wall forms and rely upon the compressive force between the wall forms to hold the buck in position. However, the heavy forces of the concrete being poured around the buck has proven to be unsettling to the buck and this method is therefore unreliable for accurately and consistently maintaining the proper position and orientation of the buck between the wall forms.

Nails may be driven through wood wall forms and into wood portions of the pouring buck or wood window frames to position them relative to the wall forms. However, the nails must be pulled out prior to disassembling the wall forms which is time consuming and potentially damaging to the wall forms. Furthermore, this technique is only practical for use with wood wall forms and window frames.

Therefore, there exists a need for an improved system and method for forming a window opening in a poured concrete wall and installing the window in that opening. The system and method should be economical, efficient and robust to withstand the forces of the poured concrete while allowing for the accurate and reliable positioning of the window in the poured concrete wall. Furthermore, the system and method must be applicable for a wide variety of window styles, sizes and materials while providing for easy installation, removal and manipulation.

SUMMARY OF THE INVENTION

These and other objectives of the invention have been attained by a system and associated method for forming a window opening in a poured concrete wall and installing the window and associated frame into the opening. The components of the system include a reusable window buck which is adapted for placement between spaced wall forms to divert poured concrete around the window buck to form the window opening in the concrete wall. Advantageously, the window buck is reusable after being removed from the concrete wall.

According to presently preferred embodiments, the window buck is a two-piece component including a mold nested with a generally rectangular frame. The mold in one embodiment is generally rectangular and roto-molded with an extension which telescopically fits within the preferably aluminum frame. In another embodiment the mold is aluminum and extends along only a portion of the frame, for example along the bottom or sill portion of the frame. With the mold extending only along one edge of the frame, a wide variety of sizes of window openings can be formed with the same mold and appropriately sized frames. As such, a contractor's cost and inventory are minimized while still offering options for window sizes.

The frame and mold are removable in opposite directions from the poured concrete wall. The window buck advantageously forms a raised ledge along a sill of the window opening proximate an interior side of the poured concrete wall to inhibit water from flowing through the window opening toward the interior side of the poured concrete wall. The raised ledge is positioned against an inner face of the window frame or window. Moreover, the window buck forms a protruding rim along a jamb at each side of the window opening against which an outer face of the window or window frame is positioned when installed in the window opening.

A component of the system according to a presently preferred embodiment of this invention is a retainer coupled to the window buck while the concrete is being poured so that the retainer is preferably partially embedded in the concrete wall proximate the window opening. The retainer preferably includes two frangible members which couple the retainer to the window buck so that upon removal of the window buck from the window opening the frangible members are broken leaving the remainder of the retainer embedded in the concrete wall. The frangible members are seated within holes in the window buck and retained there during installation and subsequent pouring of the concrete.

The retainer in a presently preferred form includes a socket which is exposed when the retainer is embedded in the concrete wall and is located along a side edge of the window opening. A window or window frame is easily snapped into the window opening and retained therein by a spring clip or other device mounted on a side edge of the window frame or window. The spring clip temporarily deflects inwardly while the window or frame is being installed until the clip is seated within the socket of the embedded retainer. Accordingly, the installation of the window or window frame is easily accomplished without tools or additional fasteners such as nails, screws or the like.

The window buck and retainer are accurately and robustly mounted between the wall forms by suspension members which in a first presently preferred embodiment is a pair of elongate bars inserted through associated sleeves in the frame of the window buck. When inserted in the sleeves, the bars project outwardly from the window buck to rest along a top edge of the wall forms. Preferably the window bucks include a plurality of sleeves at different positions so that a user may select the appropriate sleeve for the position of the window buck and resulting window opening in the poured concrete wall.

If a lintel is formed in the poured concrete wall, a second presently preferred embodiment of the suspension member is used and includes a lintel drop projecting downwardly from the bar. A terminal end of the lintel drop includes a key which mates with a keyhole slot in the window buck to selectively couple the window buck to the suspension member bar. Alternatively, the window buck frame in another embodiment includes a number of channel shaped suspension members coupled to the ties which extend between the spaced wall forms. As such, the window buck is suspended on the ties for accurate positioning between the spaced wall forms.

With the system and associated method according to this invention, a window opening is reliably formed in the desired location in a poured concrete wall without damaging a reusable, lightweight and robust window buck. Moreover, a window is efficiently and conveniently installed in the window opening without the need for tools or additional fasteners in an easy, efficient and economical manner.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
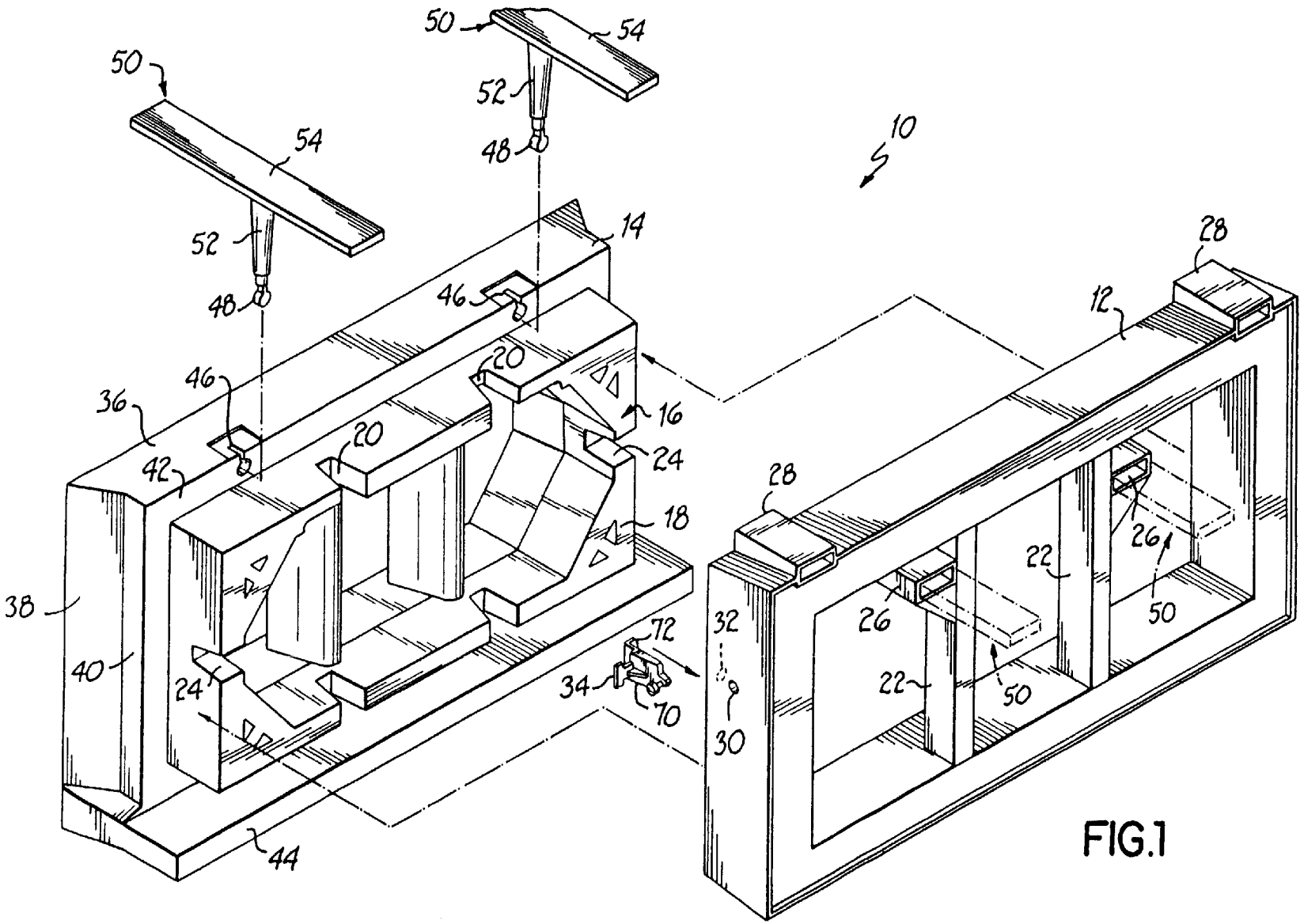
FIG. 1 is a perspective view of a first embodiment of a window buck including a frame and a mold being nested together with a retainer and suspension members being coupled thereto.
Figure 2:
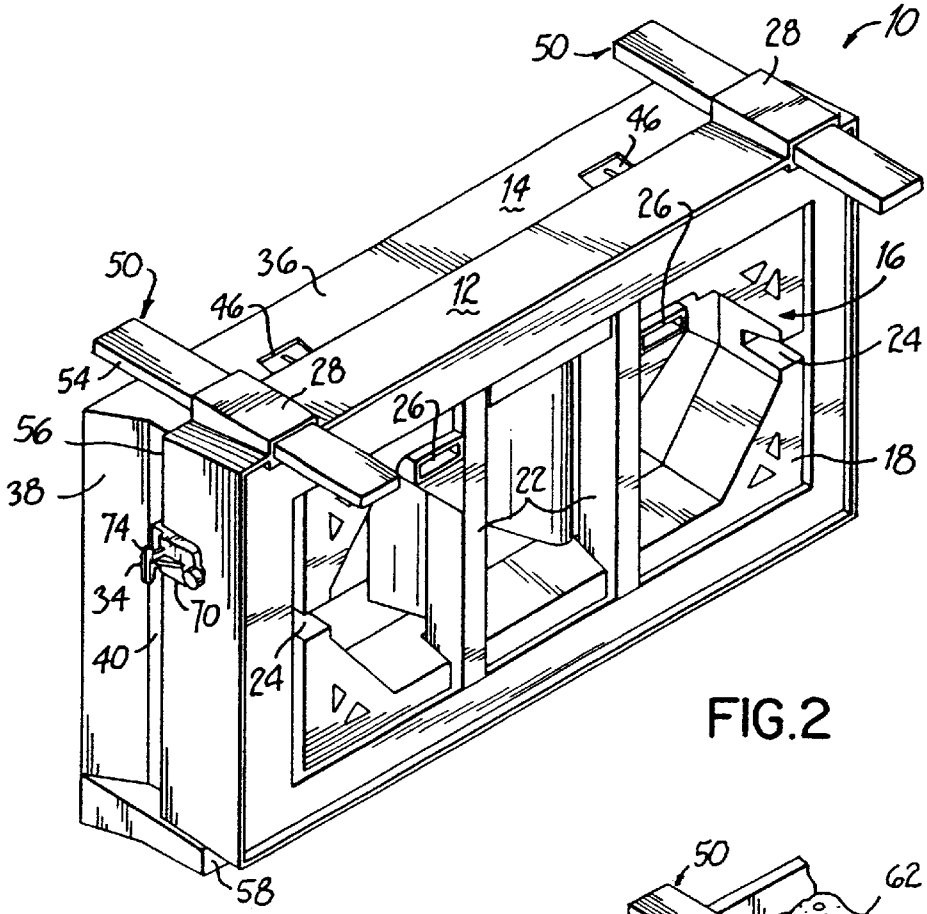
FIG. 2 is a view similar to FIG. 1 with the components in an assembled form and an alternative embodiment of a suspension member coupled to the window buck.

Referring to FIGS. 1 and 2, a first presently preferred embodiment of a window buck 10 according to this invention is shown. The window buck 10 includes a generally rectangular and preferably aluminum frame 12 which is sized and configured to nest with a generally rectangular mold 14. The mold 14 according to this presently preferred embodiment is roto-molded with a foam filled shell of medium density polyethylene. The shell thickness is preferably within a range from about one-sixteenth inch up to about one-eighth inch. The mold 14 includes a generally rectangular telescopic extension 16 which snugly fits within the interior of the frame 12 as shown in FIG. 2. The telescopic extension 16 is generally rectangular with reinforcing triangular shaped webs 18 in each corner of the extension for added support and rigidity. Upper and lower members of the telescopic extension 16 each include a pair of spaced notches 20 for receipt of reinforcing generally vertical ribs 22 on the frame 12 when nested therewith. The ribs 22 on the frame extend between upper and lower frame members. Similarly, notches 24 are provided in the end walls of the telescopic extension 16 for receipt therein of an optional cross brace (not shown) extending laterally within the frame 12.

The frame 12 includes a plurality of generally tubular rectangular-shaped sleeves welded or otherwise secured thereto. A lower pair of sleeves 26 are mounted on the exterior faces of the ribs 22. An upper pair of sleeves 28 are mounted on the upper face of the upper frame member. Preferably, the exterior face of each member of the frame 12 is tapered or sloped downwardly from an outer edge spaced from the mold 14 toward an inner edge thereof adjacent to the mold 14. The frame 12 includes a hole 30 on the exterior face of each side frame member and a hole 32 in a comparable position on the interior face of each side frame member confronting the mold 14. The holes 30, 32 are sized and positioned so that a retainer 34 can be coupled to the window buck 10 prior to installation and use of the window buck 10.

The mold 14 includes a generally rectangular peripheral case 36 which on lateral sides thereof includes a tapered section 38 and a transition section 40 generally perpendicular to a vertical bulkhead 42 which is juxtaposed against the interior face of the frame 12 nested therewith. The mold 14 also includes a lower shelf 44 spaced from the telescopic extension 16 and extending the length of the mold 14. A pair of spaced keyhole slots 46 are formed on the upper edge of the case 36 proximate the vertical bulkhead 42 thereof. Each keyhole slot 46 is sized and configured to receive therein a key 48. The key 48 is part of a first presently preferred embodiment of a suspension member 50 and has a generally barrel-shaped cylindrical configuration and is located on a terminal end of a cone or lintel drop 52 which projects downwardly from a generally rectangular plate or suspension bar 54.

Figure 3:
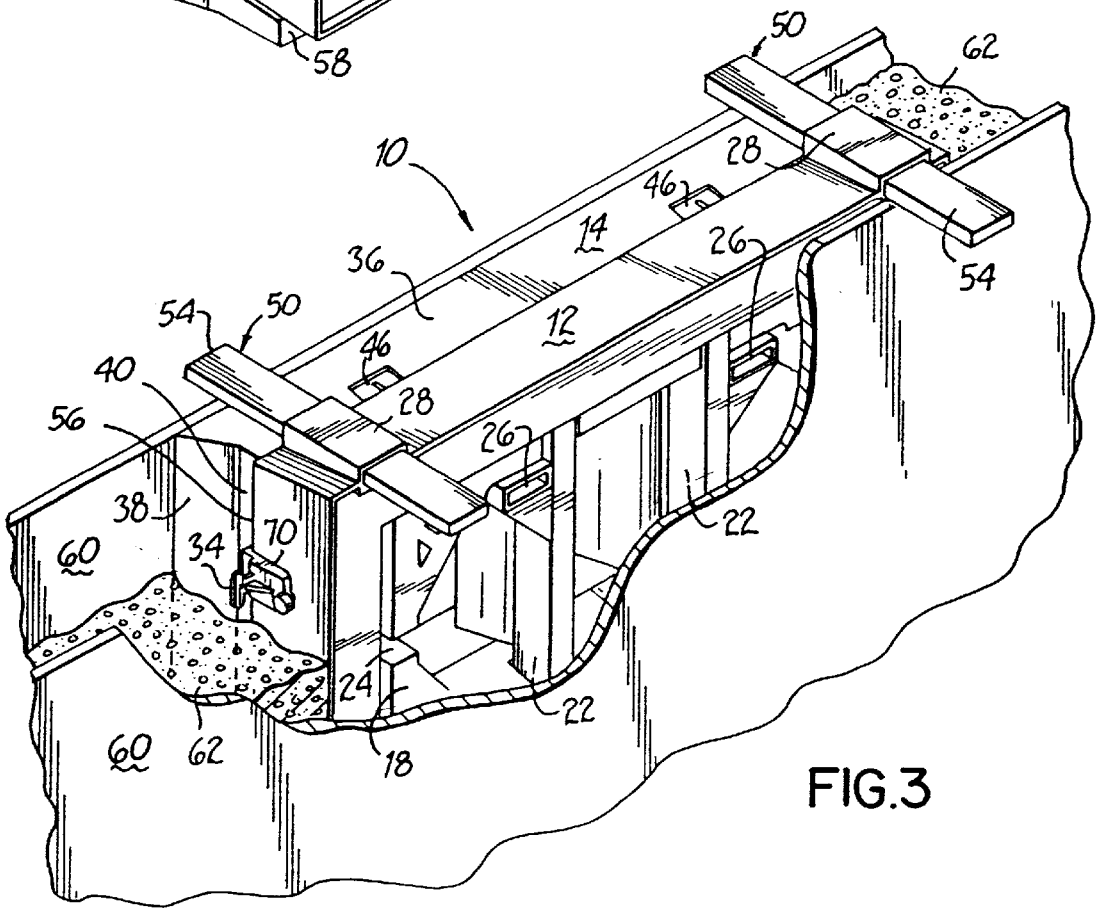
FIG. 3 is a view of the assembly of FIG. 2 installed between spaced wall forms, one of which is partially broken away, for forming a poured concrete wall and window opening.

A presently preferred alternative embodiment of the suspension member 50 for use with the window buck according to this invention is shown in FIGS. 2 and 3. The alternative embodiment of the suspension member 50 is a generally planar rectangular suspension bar 54 which is sized and configured to be inserted through one of the sleeves 26, 28 in the frame 12. Sleeves 26, 28 are provided in multiple locations to provide for different orientations and placement of the window buck 10.

As shown in FIG. 2, the lateral width of the frame 12 is greater than the lateral width of the mold 14 proximate the bulkhead 42 to thereby produce an offset 56 when the mold and frame are nested together. Similarly, the depth of the shelf 44 of the mold 14 is less than that of the frame 12 nested with the mold 14 thereby providing an offset 58 extending the length of the window buck 10 along a lower edge thereof.

Figure 4:
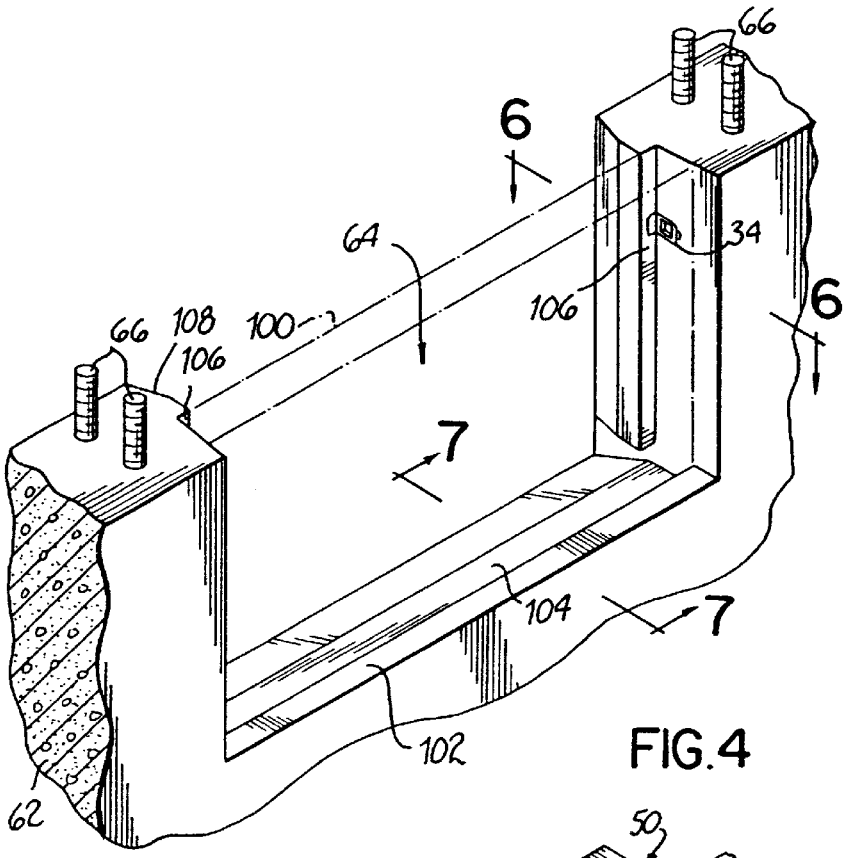
FIG. 4 is a perspective view of a window opening with a partially embedded retainer resulting from the assembled components of FIGS. 2 and 3.
Figure 5:
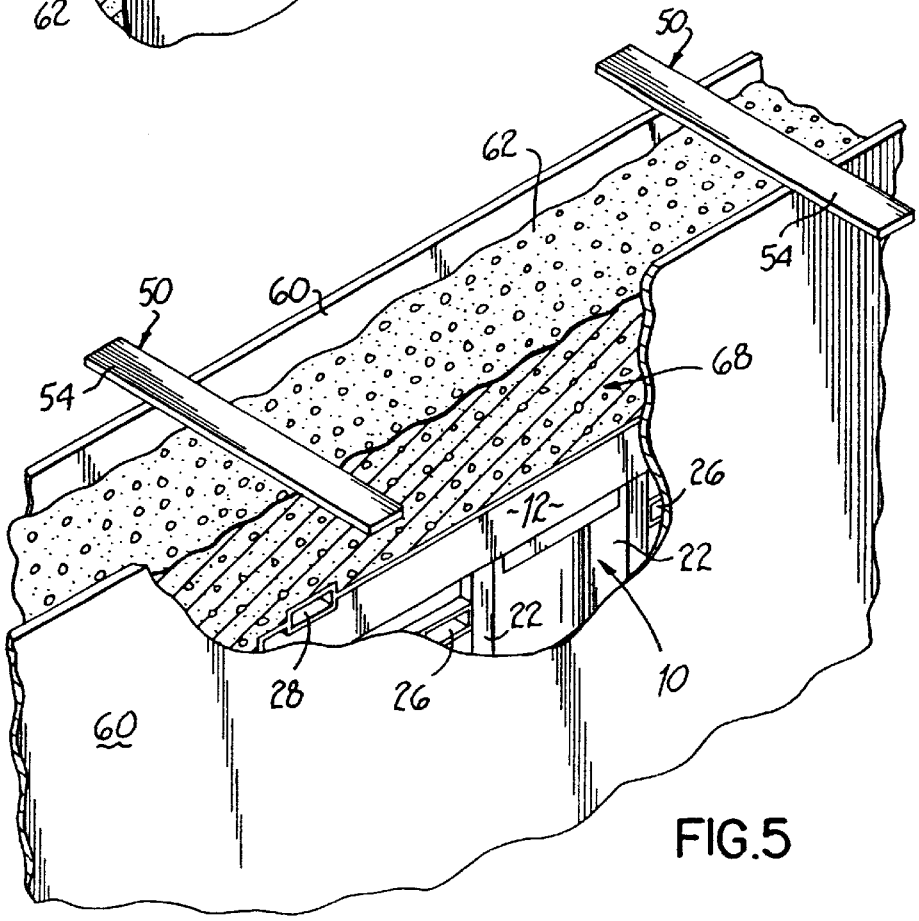
FIG. 5 is a view of the assembly of FIG. 1 installed between spaced wall forms, one of which is partially broken away, for forming a poured concrete wall and window opening with a lintel.

Specifically referring to FIG. 3, the suspension bars 54 when inserted through the upper sleeves 28 position the window buck 10 in an intermediate position with each suspension bar 54 extending across the top edges of spaced wall forms 60 sandwiching there between the window buck 10. Concrete 62 is poured between the wall forms 60 and allowed to cure thereby forming a poured concrete wall. A presently preferred embodiment of the wall form 60 is disclosed in U.S. patent application Ser. No. 09/232,414 filed Jan. 15, 1999, by the assignee of this invention and hereby incorporated by reference. The window buck 10 diverts the poured concrete 62 thereby forming a window opening 64 in the concrete wall, as shown particularly in FIG. 4. Anchor bolts 66 are commonly provided along the top edge of the poured concrete wall 62 for the construction of a house and attachment of a cap member (not shown) or the like as is readily known by those skilled in the art. The lower sleeves 26 in the frame 12 are utilized to position the window buck 10 in an alternative and higher position than the upper sleeves 28. The sleeves 26, 28 are utilized with the suspension members 50 to produce the window opening 64 in the poured concrete wall 62 which does not include a lintel 68. The suspension member 50 with lintel drop 52 and key 48, as shown in FIGS. 1 and 5, is utilized with the window buck 10 of this invention to suspend the window buck 10 between the spaced wall forms 60 when the lintel 68 is to be formed along the top edge of the window opening 64, as is readily understood by one of ordinary skill in the art. The poured concrete 62 surrounds the window buck 10 and lintel drop 52 thereby forming the lintel 68.

Figure 8:
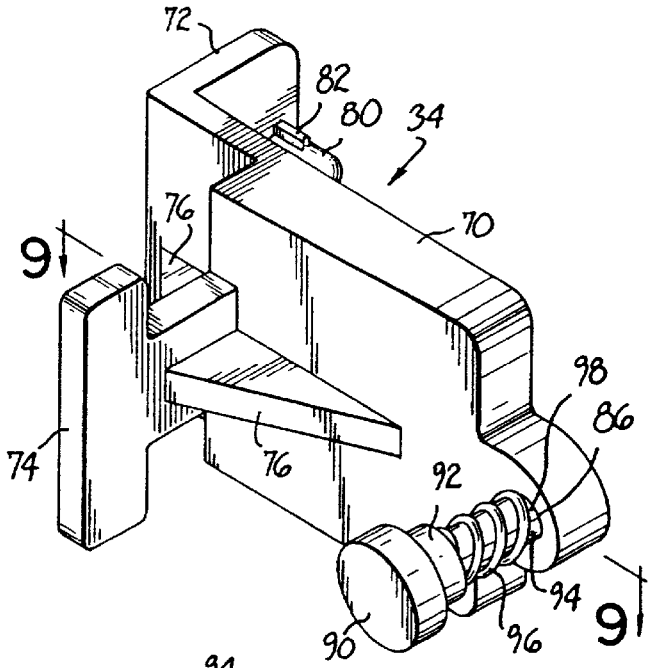
FIG. 8 is a perspective enlarged view of a presently preferred embodiment of the retainer according to this invention.
Figure 9:
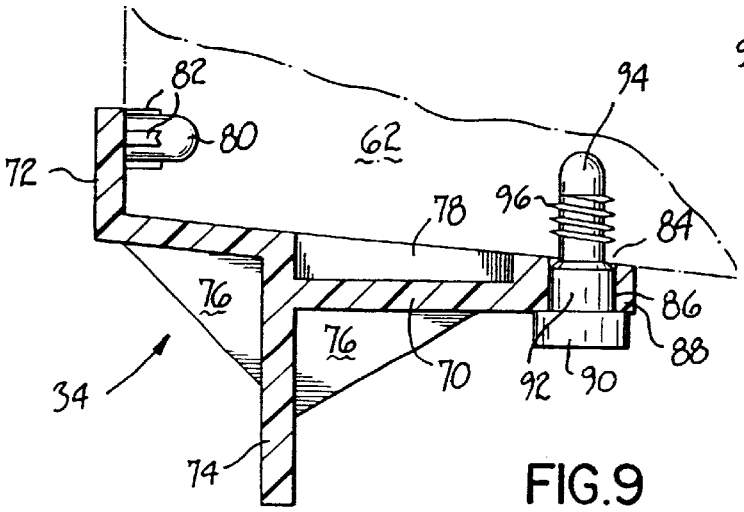
FIG. 9 is a cross-sectional view along line 9—9 of FIG. 8 with the retainer coupled to the window buck shown in phantom according to this invention.

Referring to FIGS. 8 and 9, a presently preferred embodiment of the retainer 34 according to this invention is shown. The retainer 34 is secured between the bulkhead 42 of the mold 14 and the interior face of the frame 12 when the frame 12 and mold 14 are nested together. The retainer 34 is preferably molded from any one of a number of suitable plastics such as polyethylene or the like. The retainer includes a generally L-shaped body having a first longer leg 70 and a second shorter leg 72 extending perpendicularly thereto. A T-shaped anchor tab 74 projects rearwardly from the longer leg 70 of the retainer 34 in an opposite direction from the second leg 72. The anchor tab 74 is buttressed by a pair of generally triangular-shaped gussets 76 on opposite faces of the anchor tab 74.

The retainer 34 includes a generally rectangular socket 78 formed in a face of the first leg 70 opposite from the anchor tab 74. The retainer 34 also includes a pair of frangible members projecting from terminal ends of each of the legs 70, 72. The first frangible member is in the form of a boss 80 projecting perpendicularly from the short leg 72 proximate a terminal end thereof. The boss 80 is reinforced by a number of spaced webs 82 located along the barrel thereof.

The second frangible member is in the form of a pin 84 which is received within a hole 86 in a tab 88 projecting from the terminal end of the longer leg 70 of the retainer 34. The pin 84 is oriented generally perpendicularly to the long leg 70 and can be selectively positioned to and between a retracted position as shown in FIG. 8 and an extended position as shown in FIG. 9. The pin 84 includes a generally cylindrical head 90 joined to a neck 92 region thereof. The neck 92 snugly fits within the hole 86 in the tab 88 of the retainer 34 when the pin 84 is in the extended position. The pin 84 also includes a shaft 94 having a helical thread 96 formed on an exterior surface thereof. The pin 84 is retained in the hole 86 in the tab 88 by a thin web 98 covering the hole 86 until the pin 84 is pushed into the extended position thereby rupturing the web 98 and seating the neck 92 within the hole 86.

With the pin 84 in the retracted position, the retainer 34 is easily coupled to the frame 12 of the window buck 10 by sliding the long leg 70 in face to face contact with the exterior surface of the side frame member until the boss 80 is seated within the hole 32 on the interior face of the side frame member. In this position, the pin 84 in the retracted position is aligned with the hole 30 in the face of the side frame member and can be then manually or otherwise inserted therein to securely couple the retainer 34 to the frame 12. The helical threads 96 increase the frictional interaction between the pin 84 and the hole 30.

After the concrete 62 has been poured and allowed to cure and the wall forms 60 removed from the poured concrete wall, the shaft 94 of the pin 84 and the boss 80 are easily broken or severed from the frame 12 as the frame 12 is removed from the window opening 64. The anchoring tab 74 and adjacent surfaces of the retainer 34 are embedded in the poured concrete wall 62 with the socket 78 and adjacent faces of the legs 70, 72 exposed along a side of the window opening 64, as shown in FIG. 4. The configuration of the anchor tab 74 increases the holding power of the concrete 62 to securely hold the retainer 34.

One presently preferred method of installing a window 100 in a poured concrete wall 62 according to this invention begins with erecting the pair of spaced wall forms 60. The retainer 34 is then coupled to the window buck 10 with the frangible members 80, 84 inserted into the corresponding holes 30, 32 in the frame 12 as previously described. The retainer 34 and window buck 10 are then suspended between the spaced wall forms 60 with any one of the suspension members 50, as shown in FIGS. 1–3 and 5, depending upon the desired position of the window opening 64 in the poured concrete wall 62. Concrete is then poured between the spaced wall forms 60 and around the window buck 10 thereby partially embedding the retainer 34 in the poured concrete. After the poured concrete is allowed to cure, the wall forms 60 are dismantled and the retainer 34 is uncoupled from the window buck 10 by severing, breaking or otherwise fracturing the frangible members 80, 84 from the retainer 34. The frame 12 and mold 14 are then pulled in opposite directions from the window opening 64 in the poured concrete wall 62. The frame 12 is pulled toward the interior of the wall 62 whereas the mold 14 is pulled toward the exterior of the wall 62 to thereby remove the components from the window opening 64. While a two-piece window buck 10 is shown and described, other designs are contemplated within this invention.

Figure 6:
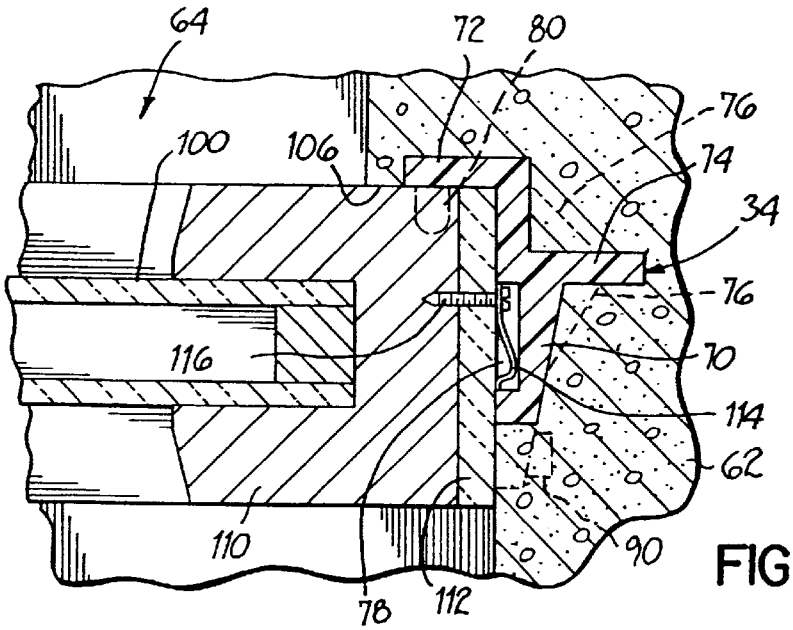
FIG. 6 is a cross-sectional view along line 6—6 of a jamb of the window opening of FIG. 4 with a window installed in the window opening and a spring clip on the window coupled to the retainer.
Figure 7:
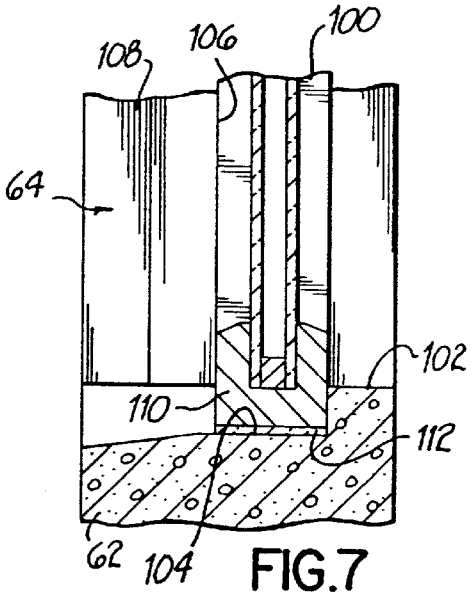
FIG. 7 is a cross-sectional view taken along line 7—7 of FIG. 4 showing a raised ledge and a sill of the window opening with a window installed therein.

The offset 58 between the shelf 44 of the mold 14 and the frame 12 forms a raised ledge 102 on a sill 104 of the window opening 64. The raised ledge 102 of the sill 104 advantageously prevents the ingress of water or other moisture to the interior of the concrete wall 62 when the window 100 is seated on the sill 104 as shown in FIG. 6.

The offsets 56 between the side frame members and the case 36 form a rim 106 along each jamb 108 of the window opening 64. Furthermore, the jamb 108 and rim 106 members in the poured concrete wall 62 inhibit the window 100 from being pulled from the window opening 64 from the exterior of the poured concrete wall 62 as a security measure.

The window 100 to be installed in the window opening 64 according to a presently preferred embodiment of this invention has a generally rectangular or other shaped configuration. The window shown and described herein is but one of many window designs that can be utilized with this invention including glass block or other window designs and materials. The window 100 preferably includes a perimeter frame 110; although, other window constructions or types can be used, such as glass blocks or the like, that may not include a perimeter frame. Preferably, the perimeter frame 110 of the window 100 includes an insulation 112 or weather strip seal extending around the periphery thereof. A metal spring clip 114 or other type of preferably outwardly biased device or the like is mounted by a bolt, screw or other fastener 116 to a side edge of the window frame 110 as shown in FIG. 6 for snap-fit engagement with the socket in the embedded retainer 34. While the spring clip 114 is a presently preferred embodiment, it should be understood that any of a variety of other devices, whether biased or not, are encompassed within this invention. The spring clip or other device is advantageously mounted on the window 100 or window frame 110 prior to installation for easier and simpler installation without the need for additional mechanical fasteners or tools during installation.

The window 100 is installed from the interior of the poured concrete wall 62 by seating a bottom edge of the window 100 or frame 110 along the sill 104 of the window opening 64 with the raised ledge 102 juxtaposed to an interior face of the window frame 110 or window 100. The window 100 is then pivoted upwardly toward the jamb members 108 formed in the window opening 64 until an exterior face of the frame 110 seats against the rims 106 on the jambs 108 at the side edges of the window opening 64. The spring clips 114 temporarily deflect inwardly as the window 100 is pivoted upwardly and then spring out to extend into the sockets 78 of the retainers 34 and thereby secure the window 100 in the window opening 64. The window 100 can be selectively removed from the window opening 64 by inserting a hook-shaped tool or other device (not shown) between the window frame 110 and the jamb 108 to deflect the spring clip 114 on the window 100 inwardly and unseat it from the socket 78 and retainer 34 and then pivot the window 100 toward the interior of the poured concrete wall 62 for removal.

As a result, the window 100 is easily installed in an efficient manner without the need for additional tools or fasteners to secure the window 100 into the formed window opening 64 in the concrete wall 62. Moreover, the window buck 10 used in forming the window opening 64 can be cleaned and subsequently reused thereby minimizing the cost for the construction of the poured concrete wall 62 and window opening 64 therein.

Figure 10:
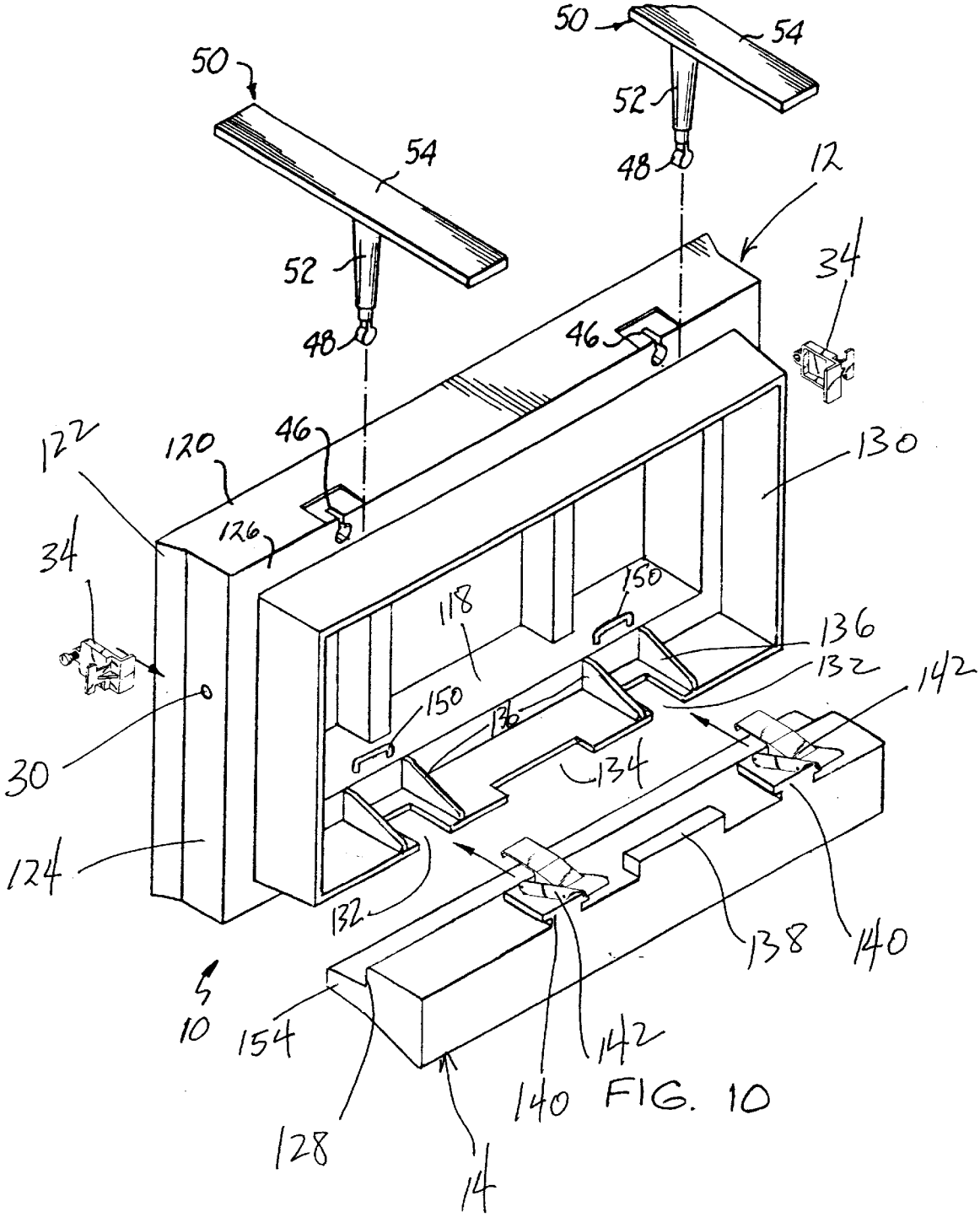
FIG. 10 is a respective view of the components of a second presently preferred embodiment of a window buck system according to this invention.
Figure 11:
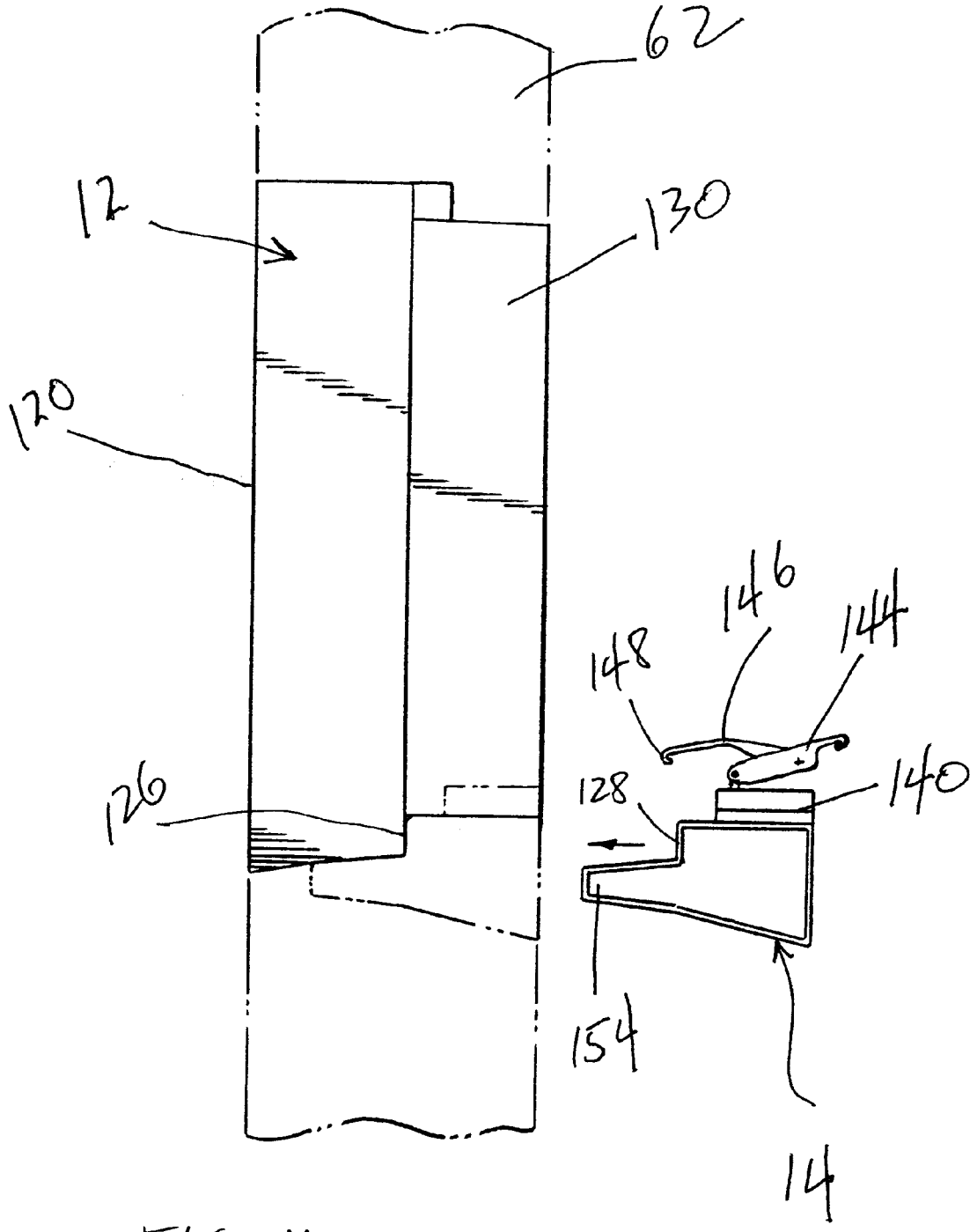
FIG. 11 is cross sectional view of the mold of the window buck of FIG. 10 being coupled to the frame.
Figure 12:
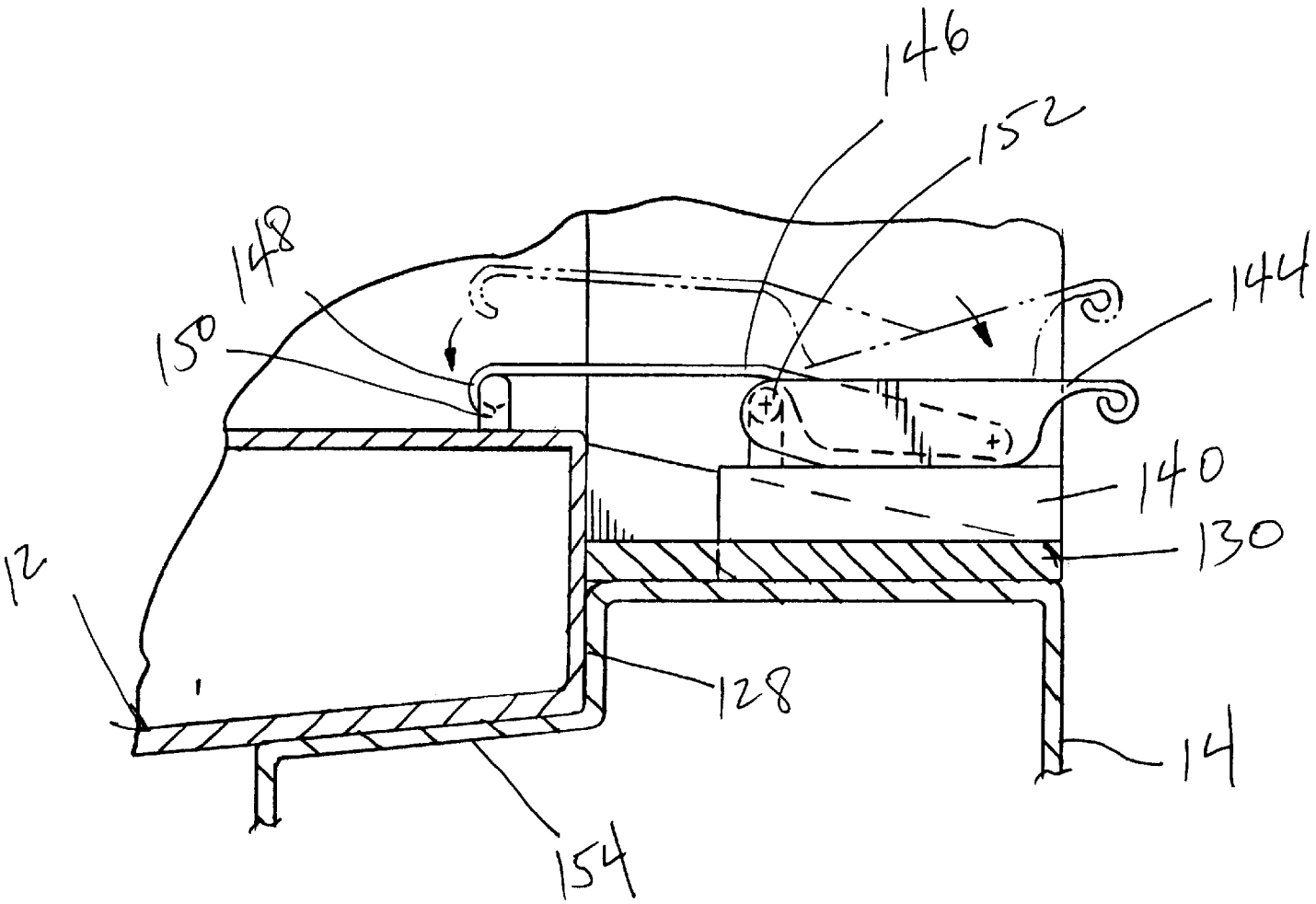
FIG. 12 is an enlarged view similar to FIG. 11 with the mold being releasably to frame.

Referring to FIGS. 10–12, a second presently preferred embodiment of the components of a window buck 10 according to this invention is shown. Specifically, the embodiment of FIG. 10 includes a frame 12 which is nested with a mold 14. The frame 12 and mold 14 nest together for positioning between spaced wall forms 60 to divert poured concrete 62 around the window buck 10 to form a window opening 64 in the poured concrete wall. After the concrete 62 is cured and the spaced wall forms 60 are dismantled, the mold 14 and frame 12 are removed from the window opening 64 in opposite directions similar to the window buck 10 previously described herein. This embodiment of the window buck 10 is lighter in weight and more maneuverable because the mold 14 extends only along a portion of the frame 12 for nesting therewith. Specifically, the mold 14 is removably nested with a lower sill portion 118 of the frame 12. The frame 12 includes a generally rectangular peripheral case 120 which on lateral sides thereof includes a tapered section 122 and a transition section 124 generally perpendicular to a vertical bulkhead 126. The vertical bulkhead 126 along the lower sill portion 118 of the frame 12 is juxtaposed against a vertical face 128 of the mold 14. A rectangular extension 130 projects from the vertical bulkhead 126 of the frame 12 and along the lower sill portion 118 thereof includes two outboard notches 132 and a center notch 134. Reinforcing gussets 136 may be provided adjacent to each side of the outboard notches 132 to extend between the vertical bulkhead 126 and rectangular extension 130 of the frame 12.

The center notch 134 is adapted to receive a generally rectangular pedestal 138 projecting from the upper surface of the mold 14 and the outboard notches 132 are each adapted to receive a T-shaped extension 140. A latch 142 is mounted on each of the T-shaped extensions 140 to releasably nest or couple the mold 14 with the frame 12. Each latch 142 includes a main body member 144 and a latch arm 146 with a hook 148 on a terminal end to engage a shackle 150 mounted on the frame 12. The latch body 144 is pivotally mounted about a pivot pin 152 to the T-shaped extension 140 to provide an over-center clamping action (FIG. 12) when the mold 14 and frame 12 are nested together. It should be readily appreciated that the latch shown and described herein is for exemplary purposes only and a wide variety of other latches, clamps or fastening schemes can be utilized to releasably secure the mold with the frame according to this invention.

Similar to the arrangement shown in FIG. 1, the embodiment of the window buck in FIGS. 10–12 includes a pair of spaced keyhole slots 46 formed on an upper edge of the case proximate the vertical bulkhead 126 of the frame 12. Each keyhole slot 46 is sized and configured to receive therein a key 48 which is located on a terminal end of a cone or lintel drop 52 which projects downwardly from a generally rectangular plate or suspension bar 54 of a suspension member 50. Alternatively, a suspension member 50 in the form of a generally rectangular suspension bar 54, similar to that shown in phantom lines in FIG. 1, can be utilized with the window buck 10 embodiment of FIG. 10. As such, the suspension bar 54 is sized and configured to be inserted through one of the sleeves (not shown in FIG. 10) in the frame 12.

The mold 14 includes a lower shelf 154 which is positioned against the lower sill portion 118 of the transition section 124 of the frame 12 when the mold 14 and frame 12 are nested together (FIGS. 11 and 12). The depth of the shelf 154 of the mold 14 is less than that of the transition section 124 on the frame 12 thereby providing an offset which forms a sill 104 in the window frame opening 64.

The frame 12 includes a hole 30 on the exterior face of the transition section 124 on each side of the frame 12. The holes 30 are sized and positioned to receive a retainer 34 prior to installation and use of the window buck 10 similar to that described and shown with respect to the embodiment of FIG. 1.

Figure 13:
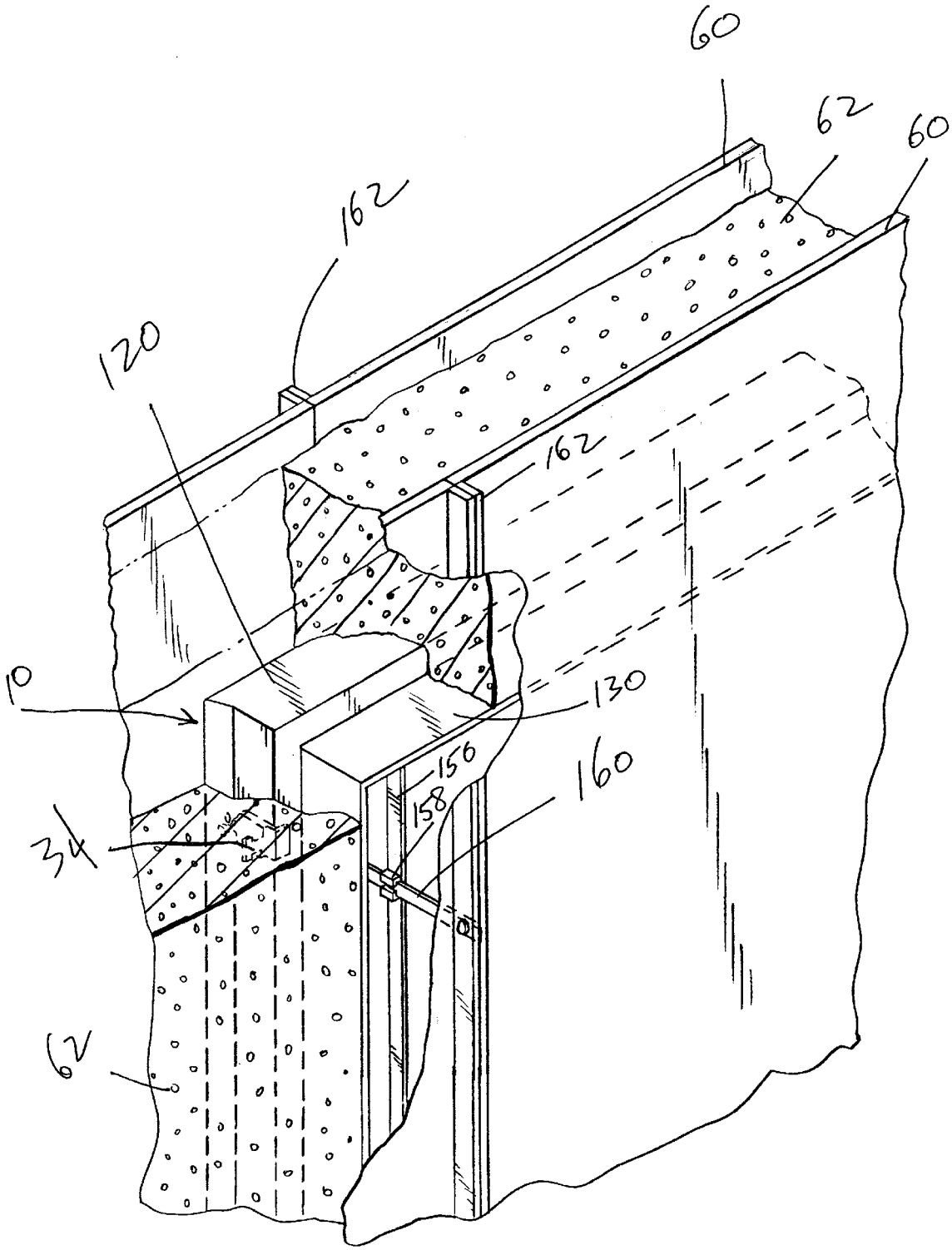
FIG. 13 is a perspective view of a third presently preferred embodiment of this invention installed between spaced wall forms, one of which is partially broken away, for forming a poured concrete wall and window opening.

Referring to FIG. 13, a third presently preferred embodiment of a window buck 10 according to this invention is shown. The window buck 10 of this embodiment is typically utilized for an egress type of window 100 with a lintel 68 formed above the window opening 64. The frame 12 of the window buck 10 of FIG. 13 includes a number of bars 156 extending generally vertically between the upper and lower frame members. Channel-shaped suspension members 158 are provided on the bars 156 at selected locations. The channel-shaped suspension members 158 are adapted to receive therethrough one of the ties 160 which extend between the spaced wall forms 60 as is well know in the industry. The ties 160 are used to maintain the accurate position and spacing of the opposed wall forms 60 and are typically positioned along the marginal frame edges 162 of adjacent wall form panels and secured in place by pins and wedges (not shown). As such, the egress window buck 10 of FIG. 13 is accurately positioned and suspended between the spaced wall forms 60 by the channel-shaped suspension members 158 which couple to the ties 160 between the spaced wall forms 60. The retainers 34, one of which is shown in phantom in FIG. 13, are positioned in the holes 30 (not shown in FIG. 13) on the bulkhead 126 of the frame 12 of the window buck 10. Preferably, the retainers 34 are positioned approximately 11 inches from the corners of the frame 12 and one retainer is positioned on each side of the rectangular frame 2.

From the above disclosure of the general principles of the present invention and the preceding detailed description of at least one preferred embodiment, those skilled in the art will readily comprehend the various modifications to which this invention is susceptible. For example, numerous other configurations and/or designs for the window buck, retainer and spring clip are possible within the scope of this invention. Therefore, we desire to be limited only by the scope of the following claims and equivalents thereof.

We claim:

1. A system for forming a window opening in a poured concrete wall, the window opening being adapted to retain a window therein, the poured concrete wall being formed from cured concrete previously poured between spaced wall forms, the system comprising:

a reusable window buck being adapted for placement between the spaced wall forms to divert the poured concrete around the window buck and form the window opening in the concrete wall, the window buck being removable from the poured concrete wall for subsequent re-use after the wall forms are removed from the poured concrete wall, wherein the window buck further comprises:

(a) a generally rectangular frame; and (b) a mold nested with the frame and being adapted for placement between the spaced wall forms to divert the poured concrete around the mold and frame to form the window opening in the concrete wall, the frame and mold being removable in opposite directions from the poured concrete wall for subsequent re-use after the wall forms are removed from the poured concrete wall; and a retainer coupled to the window buck while the concrete is being poured around the window buck, the retainer being adapted to be at least partially embedded in the concrete wall proximate the window opening and adapted to be uncoupled from the window buck when the window buck is removed from the poured concrete wall, the retainer being adapted to provide an attachment location for securing the window within the window opening.

2. The system of claim 1 further comprising:

at least one suspension member coupled to the window buck to suspend and position the window buck and retainer between the wall forms.

3. The system of claim 2, wherein the spaced wall forms have ties extending there between and the suspension member is adapted to be coupled to the ties to suspend and position the window buck and retainer.

4. The system of claim 1 wherein the retainer includes a socket that is exposed when the retainer is embedded in the poured concrete wall, the socket being adapted to receive therein a device on the window to selectively retain the window in the window opening.

5. The system of claim 4 wherein at least one retainer is coupled to each side edge of the window buck.

6. The system of claim 1 wherein the window buck includes a lower portion which is adapted to form a raised ledge along a sill of the window opening proximate an interior side of the poured concrete wall to inhibit water from flowing through the window opening toward the interior side of the poured concrete wall, the raised ledge being juxtaposed against a lower portion of the window when installed in the window opening.

7. The system of claim 6 wherein the window buck includes a pair of lateral side portions each of which is adapted to form a rim along a side edge of the window opening against which a portion of an outer face of the window is juxtaposed when installed in the window opening.

8. The system of claim 1 further comprising:

a latch to releasably couple the frame to the mold.

9. The system of claim 1 wherein the mold is adapted to nest only along a sill portion of the generally rectangular frame.

10. A system for forming a window opening in a poured concrete wall, the window opening being adapted to retain a window therein, the poured concrete wall being formed from cured concrete previously poured between spaced wall forms, the system comprising:

a generally rectangular frame;

a mold nested with the frame which in combination form a window buck being adapted for placement between the spaced wall forms to divert the poured concrete around the mold and frame to form the window opening in the concrete wall, the frame and mold being adapted to be removed in opposite directions from the poured concrete wall for subsequent re-use after the wall forms are removed from the poured concrete wall; and a retainer adapted to be coupled to the window buck while the concrete is being poured around the window buck, the retainer adapted to be at least partially embedded in the concrete wall proximate the window opening and adapted to be uncoupled from the window buck when the window buck is removed from the poured concrete wall, the retainer adapted to provide an attachment location for securing the window within the window opening.

11. The system of claim 10 wherein the retainer includes a socket that is adapted to be exposed when the retainer is embedded in the poured concrete wall, the socket being adapted to receive therein a clip on the window to selectively retain the window in the window opening.

12. The system of claim 10 further comprising:

at least one suspension member adapted to be coupled to the window buck and a portion of the wall forms to suspend and position the window buck and retainer between the wall forms.

13. A method of installing a window in a poured concrete wall comprising the steps of:

erecting a pair of spaced wall forms which have a plurality of ties extending there between;

temporarily coupling a retainer to a window buck, wherein the window buck comprises a frame nested with a mold;

suspending the retainer and the window buck on the ties and between the spaced wall forms;

pouring concrete between the spaced wall forms and around the window buck, the retainer being at least partially embedded within the poured concrete;

curing the poured concrete to form the poured concrete wall;

dismantling the wall forms from the poured concrete wall;

uncoupling the retainer at least partially embedded in the poured concrete wall from the window buck;

removing the window buck from the poured concrete wall to thereby expose a window opening in the poured concrete wall, a portion of the retainer being exposed in the poured concrete wall, wherein the removing of the window buck from the poured concrete wall comprises removing the frame and the mold in opposite directions from the poured concrete wall;

inserting a window in the window opening; and engaging a member mounted on a periphery of the window with the exposed portion of the retainer to thereby secure the window in the window opening in the poured concrete wall.

* * * * *

UNITED STATES PATENT AND TRADEMARK OFFICE

CERTIFICATE OF CORRECTION

PATENT NO. : 6,550,194 B2 
DATED : April 22, 2003
INVENTOR(S) : James W. Jackson and John W. Poynter It is certified that error appears in the above-identified patent and that said Letters Patent is hereby corrected as shown below:

Column 4,
Line 51, "Fig. 10 is a respective view of" should read -- Fig. 10 is a perspective view of --.
Line 55, "Fig. 11 is a cross sectional view of" should read -- Fig. 11 is a cross sectional view of --.
Line 58, "with the mold being releasably to frame;" should read -- with the mold being releasably latched to the frame; --.

Signed and Sealed this

Twenty-sixth Day of August, 2003

JAMES E. ROGAN
*Director of the United States Patent and Trademark Office*